US006722453B1

(12) United States Patent
Crooks

(10) Patent No.: US 6,722,453 B1
(45) Date of Patent: Apr. 20, 2004

(54) STABILIZED DOWNHOLE DRILLING MOTOR

(76) Inventor: Jay C. A. Crooks, 4623 - 12th Street NE, Calgary AB (CA), T2E 4R3

( * ) Notice: Subject to any disclaimer, the term of this patent is extended or adjusted under 35 U.S.C. 154(b) by 0 days.

(21) Appl. No.: 09/857,971

(22) PCT Filed: Nov. 30, 1999

(86) PCT No.: PCT/CA99/01143

§ 371 (c)(1),
(2), (4) Date: Jun. 13, 2001

(87) PCT Pub. No.: WO00/36265

PCT Pub. Date: Jun. 22, 2000

(51) Int. Cl.[7] ..... E21B 4/02
(52) U.S. Cl. ..... 175/97; 175/325.5
(58) Field of Search ..... 175/62, 92, 93, 175/97, 325.1, 325.3, 325.4, 325.5

(56) References Cited

U.S. PATENT DOCUMENTS

| | | | | |
|---|---|---|---|---|
| 3,561,549 A | * | 2/1971 | Garrison et al. | 175/323 |
| 4,011,917 A | * | 3/1977 | Tiraspolsky et al. | 175/107 |
| 4,049,066 A | | 9/1977 | Richey | |
| 4,156,374 A | * | 5/1979 | Shwayder | 175/325.2 |
| 4,384,626 A | * | 5/1983 | Derouin | 175/325.4 |
| 4,465,147 A | | 8/1984 | Feenstra et al. | |
| 4,492,276 A | | 1/1985 | Kamp | |
| 4,646,856 A | * | 3/1987 | Dismukes | 175/107 |
| 4,862,974 A | | 9/1989 | Warren et al. | |

FOREIGN PATENT DOCUMENTS

| | | | |
|---|---|---|---|
| EP | 0554977 | * | 8/1993 |
| GB | 1563688 | | 8/1974 |
| GB | 2059481 A | | 4/1981 |

* cited by examiner

*Primary Examiner*—Thomas B. Will
*Assistant Examiner*—Meredith Petravick
(74) *Attorney, Agent, or Firm*—Bennett Jones LLP

(57) ABSTRACT

A downhole drilling motor comprises a housing including an integral stabilizing configuration. The stabilizing configuration may include a number of ribs which project from the surface of the housing and run longitudinally or helically along the housing. The stabilizing configuration may be a result of the cross-sectional shape of the housing which may be substantially triangular or square such that the diameter of a circle which circumscribes the cross section of the housing is substantially the same as the diameter of the borehole within which the motor may be used.

13 Claims, 5 Drawing Sheets

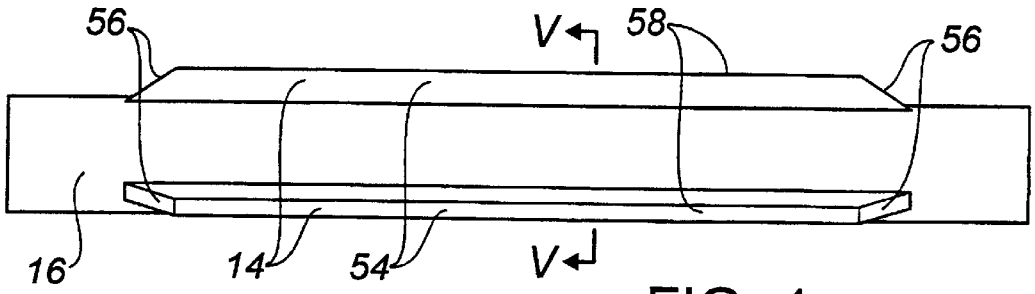
FIG. 4
FIG. 5
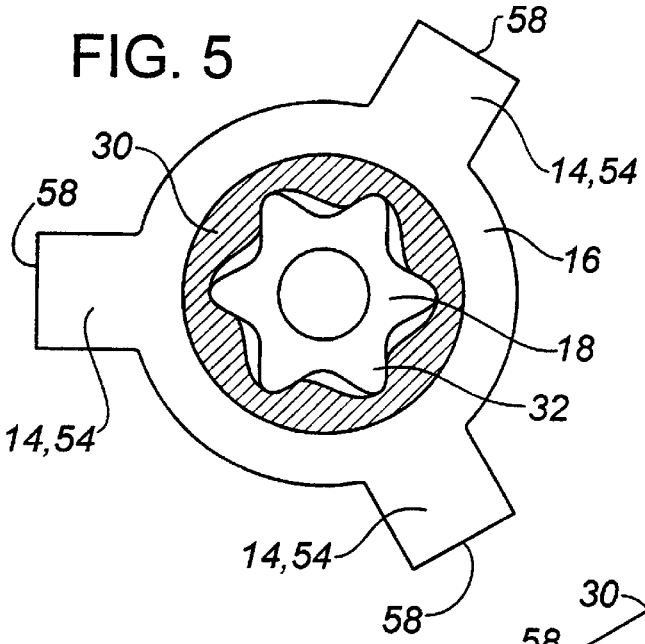
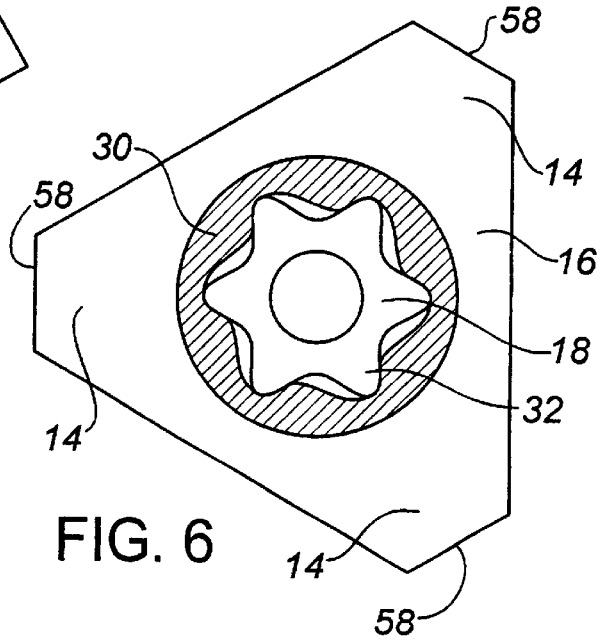
FIG. 6

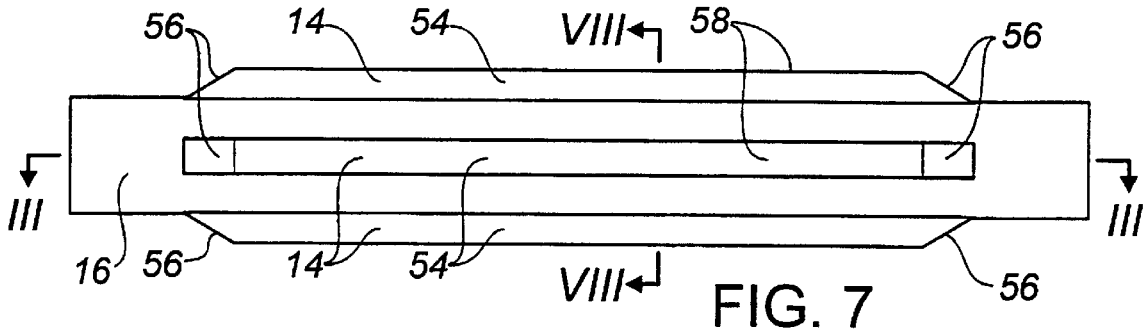
FIG. 7
FIG. 8
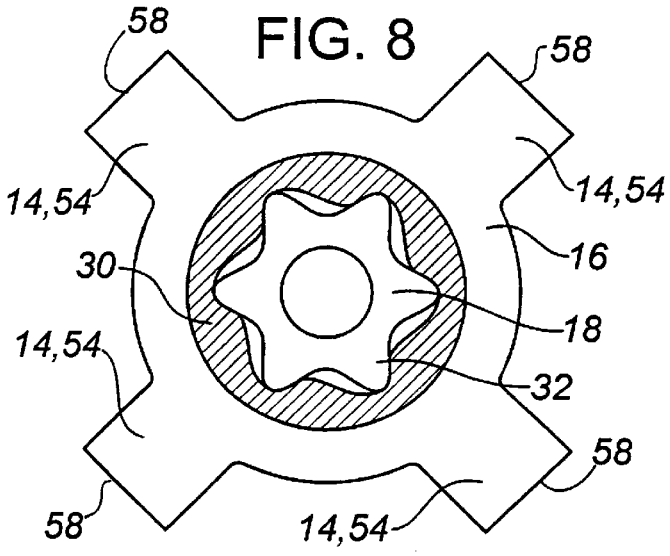
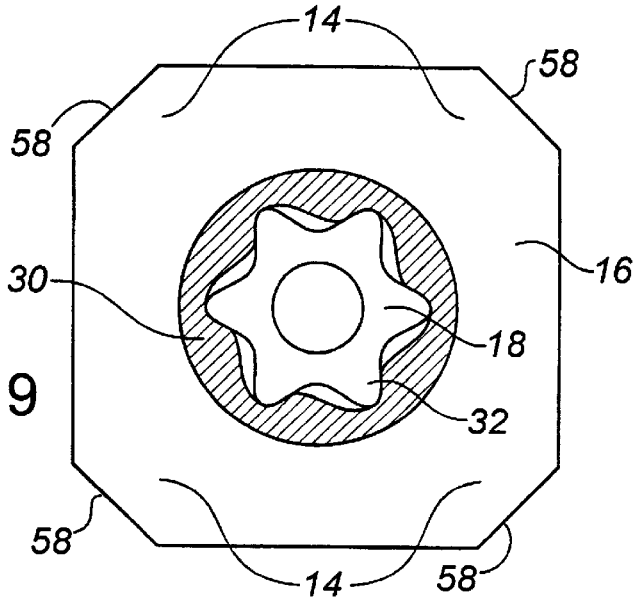
FIG. 9

STABILIZED DOWNHOLE DRILLING MOTOR

FIELD OF THE INVENTION

The present invention relates to downhole drilling motor assemblies and, in particular, a stabilized downhole drilling motor housing.

BACKGROUND OF THE INVENTION

In conventional oilfield drilling operations, a downhole drilling motor is often used to rotationally drive a toothed drill bit to bore the hole. The downhole motor is connected to a series of length of drill pipe which makes up the pipe string or drill string. The pipe string allows drilling mud to be pumped through the downhole motor to power the motor. The drilling mud then circulates around the drill bit and back up to the surface.

Typically, the pipe string and the various components of the downhole drilling motor are cylindrical and of a smaller diameter than the borehole, so as to permit drilling mud and cuttings to flow back to the surface in the annular space between the pipe string and the borehole, and to reduce drag as the pipe string and downhole drilling motor are rotated and moved up or down within the borehole.

Typically, the pipe string/downhole drilling motor combination has a low diameter to length ratio: the diameter can be measured in inches and the length can be measured in hundreds of feet. The pipe string/downhole drilling motor combination is therefore relatively flexible and under the longitudinal compression experienced during drilling, the pipe string/downhole drilling motor combination will tend to flex and push against the sides of the bore hole. As a result during drilling operations, when downward force is being applied to the pipe string, the unsupported pipe string and downhole drilling motor may not be centred in the borehole, which can misalign the drill bit, as is illustrated in prior art FIG. 1. When the drill bit is misaligned, it does not drill in the desired direction, and instead of following a relatively straight path, the borehole wanders in an uncontrolled manner. Typically, in oilfield drilling the goal is to drill into the petroleum bearing formation at a specific location chosen for optimum recovery of the oil or gas. The driller's ability to do so is reduced if the path of the borehole cannot be accurately controlled.

In conventional drilling operations, this problem of misalignment of the drill bit is mitigated by positioning a lower stabilizer immediately adjacent the drill bit (38), and an upper stabilizer (40) between the pipe string and the downhole drilling motor, as is shown in prior art FIG. 1. However, this configuration is not always effective in keeping the drill bit properly aligned as the upper stabilizer is usually not sufficiently proximate to the lower stabilizer to keep the downhole drilling motor assembly centred in the borehole because the downhole drilling motor is usually 2.5, or more, meters in length and it is subject to the flexing forces imparted by the unsupported pipe string. As well, adding the upper stabilizer introduces an additional joint between components of the downhole drilling motor. These so called "tool joints" are the weakest part of the downhole drilling motor assembly and it is recognized that as a general practice, the fewer tool joints the better.

Therefore, there is a need in the art for an improved downhole drilling motor system which mitigates the difficulties of the prior art.

SUMMARY OF THE INVENTION

In one aspect of the invention and in general terms, the invention is a downhole drilling motor having a power section comprising a housing and an internal motor mechanism which powers a rotating drill bit which drills a borehole, wherein said housing comprises:

(a) an internal bore enclosing the internal motor mechanism, and (b) an external surface having at least one stabilizing rib; wherein said stabilizing rib contacts the borehole wall when the downhole drilling motor is in use and is effective to stabilize the motor within the borehole.

The stabilizing rib or ribs may be oriented helically about the longitudinal axis of the housing. Alternatively, the stabilizing ribs may be oriented substantially parallel to the longitudinal axis of the housing in which case there may be three or more stabilizing ribs.

In another aspect of the invention, the invention comprises a downhole drilling motor having an internal motor mechanism which powers a rotating drill bit for use in drilling a borehole, and having a power section comprising a housing wherein the diameter of the smallest circle which circumscribes a cross-sectional profile of said housing along a plane normal to a longitudinal axis of said housing at any point along the length of the housing is substantially the same as the diameter of the borehole.

The housing may be configured such that the smallest circumscribing circle touches the cross-sectional profiles of said housing at at least three points. The cross-sectional profiles of the housing may be substantially a triangle or an equilateral triangle.

The housing may be configured such that the smallest circumscribing circle touches the cross-sectional profiles of said housing at four points. The cross-sectional profiles of the housing may be substantially quadrilateral or square.

The cross-sectional profiles of the housing may be substantially circular and comprise at least three projections corresponding to the at least three points touching the smallest circumscribing circle. The projections may correspond to ribs disposed longitudinally on said housing or may correspond to ribs disposed helically on said housing.

In yet another aspect of the invention, the invention comprises an elongate downhole drilling motor housing comprising an external stabilizing configuration having a stabilizing surface which contacts the walls of a circular borehole to effectively stabilize the housing within the borehole and defining passages through which drilling mud may pass upwards between the housing and the borehole walls or through the housing itself.

The stabilizing configuration may comprise at least one rib, and preferably three ribs which are disposed helically about the housing.

The stabilizing configuration may comprise at least three ribs which are disposed substantially longitudinally along the housing.

The ribs may be integral with the housing or rigidly affixed to the housing.

The ribs may be formed by the corner portions of a triangular or quadilateral cross-sectional shape of the housing.

BRIEF DESCRIPTION OF THE DRAWINGS

The invention will now be described by way of exemplary embodiments with reference to the accompanying simplified, diagrammatic, not-to-scale drawings. In the drawings:

FIG. 4 is an external view of the power section of one embodiment of the stabilized downhole drilling motor showing the integral stabilizer in the form of three longitudinal ribs.

FIG. 5 is a cross-sectional view of the embodiment shown in FIG. 4.

FIG. 6 is a cross-sectional view of the power section of one embodiment of the stabilized downhole drilling motor showing the integral stabilizer in the form of a substantially triangular prism shaped power section housing.

FIG. 7 is an external view of the power section of one embodiment of the stabilized downhole drilling motor showing the integral stabilizer in the form of four longitudinal ribs.

FIG. 8 is a cross-sectional view of the embodiment shown in FIG. 6.

FIG. 9 is a cross-sectional view of the power section of one embodiment of the stabilized downhole drilling motor showing the integral stabilizer in the form of a substantially square prism shaped power section housing.

DETAILED DESCRIPTION OF THE INVENTION

The present invention provides for a downhole motor having a power section housing that has an integral stabilizing configuration. When describing the present invention the following terms have the following meanings, unless indicated otherwise. All terms not defined herein have their common art-recognized meanings.

Definitions

The term "borehole" refers to the hole created by a drilling bit, wherein said hole is substantially circular in cross-section.

The terms "stabilize", "stabilized" and "stabilizing" all refer to the position of and support given to the motor within the borehole. When the motor is stabilized, it is substantially centred within the borehole such that it is axially aligned with the borehole.

Description

The invention according to the Figures comprises a downhole drilling motor (10) having an integral stabilizer (14). The invention comprises the external stabilizing configuration of the downhole drilling motor (10).

Figure 1:
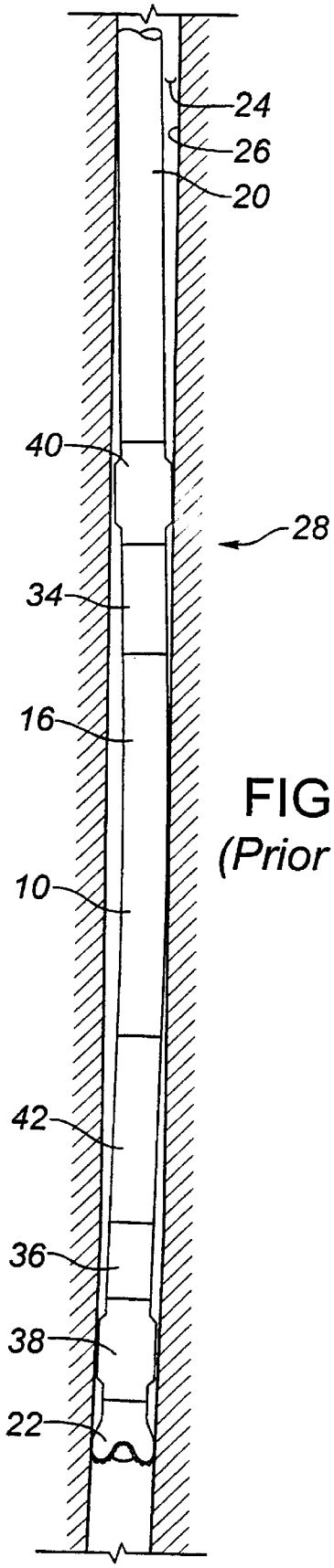
FIG. 1 (Prior Art)
FIG. 1 is a schematic prior art drawing of a conventional drill bit, downhole drilling motor, and pipe string combination in a borehole.

FIG. 1 shows a conventional drill bit (22), a prior art downhole drilling motor (10) and pipe string (20) combination, having an upper stabilizer (40) and a lower stabilizer (38), in use in a borehole (24). Downward force on the pipe string (20) is causing it to flex and push against the borehole wall (26). The pipe string is imparting a flexing force to the downhole drilling motor (10) which is flexing despite the presence of the upper stabilizer (40). This flexing of the downhole drilling motor (10) is causing the drill bit (22) to be misaligned. The flexing of the different components is exaggerated for illustration purposes; however, it only takes a small misalignment of the drill bit (22) for the drill bit (22) to diverge from the optimum path.

Figure 2:
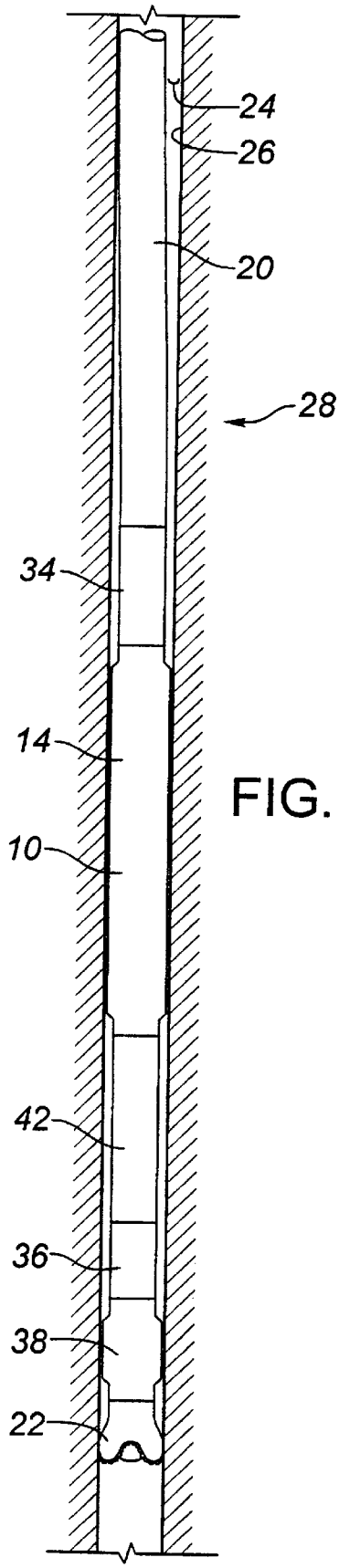
FIG. 2 is a longitudinal sectional simplified view of the drill bit and components of a downhole drilling motor having a motor housing according to the present invention.

FIG. 2 shows the effect the stabilized downhole motor (10) has on the alignment of the drill bit (22). FIG. 2 shows a drill bit (22), a stabilized downhole drilling motor (10) and pipe string (20) combination having a lower stabilizer (38). The drill bit (22) is properly aligned because the integral stabilizer (14) of the mud motor housing (16) is sufficiently long and sufficiently proximate to the drill bit (22) to adequately resist the flexing force imparted by the pipe string (20).

The drilling motor (10) encloses an internal motor mechanism (18), typically comprising a lobed stator (30) and a helical rotor (32) as is well known in the art. The rotor (32) is positioned within the stator (30). Drilling mud (23) is pumped down the pipe string (20) and through the interstices between the rotor (32) and the stator (30), which are configured such that this flow of drilling mud (23) causes the rotor (32) to rotate.

Figure 3:
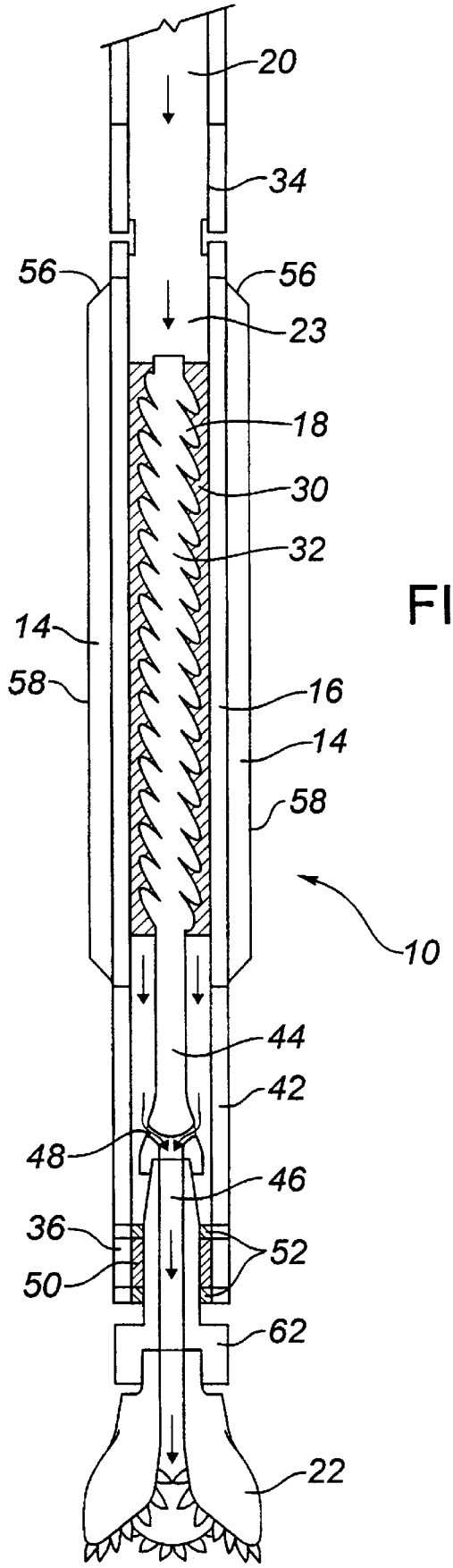
FIG. 3 is a schematic drawing of a drill bit, downhole drilling motor, and pipe string, combination incorporating a stabilized downhole drilling motor, in a borehole.

The power function of the downhole drilling motor (10) is wholly conventional, well known in the art and not essential to the invention. As shown in FIG. 3, the downhole drilling motor (10) is powered by the fluid pressure of drilling mud (23) which is pumped from the surface down the pipe string (20). Starting from the end of the downhole drilling motor (10) connected to the pipe string (23), the downhole drilling motor (10) may include the following components: a dump sub (34), which has a means of relieving excess pressure in the drilling mud (23) if, for example, the downhole drilling motor (10) becomes plugged; a mud motor (18) which converts the fluid pressure of the drilling mud into a rotary motion; a conrod housing (42) containing a conrod (44); and a rotating sub (62) which passes through the bearing housing (36) and is connected at one end to the conrod (44) and at the other end to the drill bit (22). The bearing housing (36) contains a bearing (50) and seals (52).

The end of the conrod (44) connected to the rotating sub (62) has ports (48) suitable for the passage of drilling mud (23) which communicate with the mud channel (46) inside the rotating sub (62). The conrod (44) is connected to the rotor (32) and the conrod acts to transmit the rotary motion, created in the mud motor (18), to the rotating sub (62) and the drill bit (22). The drill bit (22) is attached to the end of the rotating sub (62) and is configured such that the drilling mud (23) flowing in the mud channel (46) can pass through the centre of the drill bit (22) to the bottom of the borehole (24) where it acts to clean the cuttings. The drilling mud flows (23) to the surface in the space between the pipe string (20) and the wall of the borehole (26), carrying the cuttings with it.

In use, the pipe string (20) and the drill bit (22) are often both rotated, though at different speeds. The drill bit (22) is typically rotated at about 120 revolutions per minute. The pipe string (20) is typically rotated at about 20 revolutions per minute. The rotation of the pipe string (20) may help the drilling mud (23) and cuttings flow to the surface.

In one embodiment of the invention, shown in FIGS. 4 and 5, the integral stabilizer (14) is in the form of three longitudinal ribs (54) attached to the exterior of the mud motor housing (16). The longitudinal ribs have stabilizing surfaces (58) which are the contact surfaces for the walls of the borehole and may have tapered ends (56).

In another embodiment of the invention, shown in cross-section in FIG. 6, the exterior of the mud motor housing (16) is substantially a triangular prism with stabilizing surfaces (58).

A circle which circumscribes the cross-sectional profile of either the embodiment shown in FIG. 5 or FIG. 6 will contact the profile at 3 points, being the three stabilizing surfaces (58).

In another embodiment of the invention, shown in FIGS. 7 and 8, the integral stabilizer (14) is in the form of four longitudinal ribs (54) attached to the exterior of the mud motor housing (16). The longitudinal ribs (54) may have tapered ends (56).

In one embodiment of the invention, shown in FIG. 9, the exterior of the mud motor housing (16) is substantially a quadrilateral prism having stabilizing surfaces (58).

A circle which circumscribes the cross-sectional profile of either the embodiment shown in FIG. 8 or FIG. 9 will contact the profile at 4 points, being the four stabilizing surfaces (58).

Figure 10:
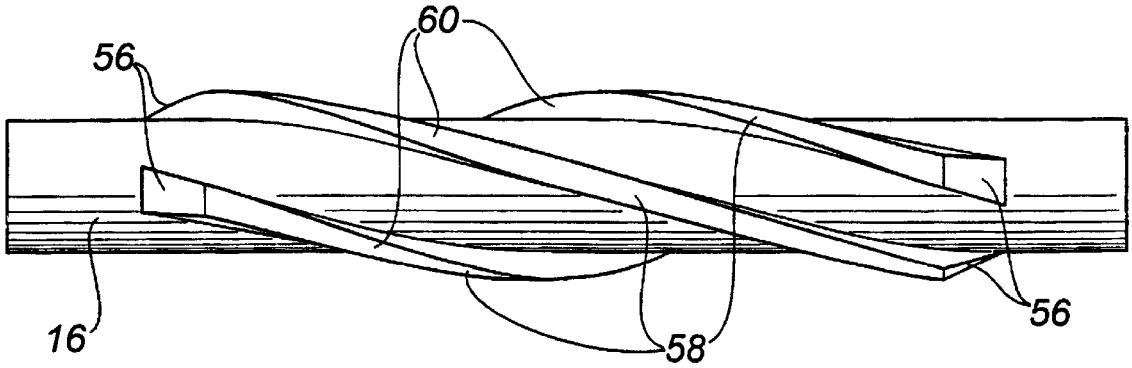
FIG. 10 is an external view of the power section of one embodiment of the stabilized downhole drilling motor showing the integral stabilizer in the form of three helical ribs.

In another embodiment of the invention, shown in FIG. 10, the integral stabilizer (14) is in the form of three helical ribs (60) attached to the exterior of the mud motor housing (16). The helical ribs (60) have tapered ends (56) and stabilizing surfaces (58). In use, when the downhole drilling motor (10) is being rotated during drilling, the helical ribs (60) act as an auger to assist in propelling the drilling mud (23) and cuttings toward the surface. As may be apparent to one skilled in the art, a single helical rib (60) or two helical ribs will also perform a similar stabilizing and augering function if the pitch of the helix is sufficiently low. At least three helical ribs is preferred because of the additional longitudinal stiffness which is imparted to the motor (10).

In any embodiment, the stabilizing surfaces (58) may be hardened so as to better withstand the wear caused by contacting the wall of the borehole. The stabilizing surfaces (58) may have a have a surface coating of tungsten carbide (not shown) or carbide buttons (not shown) may be attached to the stabilizing surfaces (58).

As is apparent by the disclosure of the various embodiments herein, a stabilizing configuration may be achieved by having a housing (16) with a cross-sectional shape which forms integral stabilizing ribs (14) such as a triangular or square shape. Alternatively, a stabilizing configuration may be achieved by rigidly affixing ribs (14) to a motor housing (16).

As will be apparent to those skilled in the art, various modifications, adaptations and variations of the foregoing specific disclosure can be made. For example, in each embodiment described herein, the stabilizing ribs (14) or helical ribs (60) are continuous along the length of the motor housing which stiffens the housing longitudinally. It is obvious that a similar stabilizing effect may be achieved, with some loss of rigidity, by strategically placing stabilizing ribs (14, 60) discontinuously along the length of the motor housing (16) such that the entire motor housing is still supported within the borehole. Any such variations are intended to be encompassed by the claims appended hereto.

The embodiments of the invention in which an exclusive property or privilege is claimed are defined as follows:

1. A downhole drilling motor for use in forming a borehole through a formation, the downhole drilling motor comprising:

an elongate housing having an outer surface and a longitudinal axis;

a lobed stator within the housing for accepting a helical rotor therein;

and at least three stabilizing ribs formed integral with the housing and extending out from the outer surface to stabilize the motor within the borehole, wherein each stabilizing rib is elongate, extending substantially parallel to the longitudinal axis of the housing and continuous along substantially the whole length of the housing.

2. The downhole drilling motor of claim 1 wherein there are three stabilizing ribs configured such that the housing has a substantially triangular shape in transverse cross-section.

3. The downhole drilling motor of claim 1 wherein there are four stabilizing ribs configured such that the housing has a substantially square shape in transverse cross-section.

4. The downhole drilling motor of claim 1 wherein the housing is tapered at its ends to facilitate passage through the borehole.

5. The downhole drilling motor of claim 1 wherein the stabilizing ribs are hardened by coating with tungsten carbide.

6. The downhole drilling motor of claim 1 wherein the stabilizing ribs are hardened by attaching carbide buttons thereto.

7. A downhole drilling motor comprising:

a housing having a longitudinal axis extending between tapered ends;

an internal motor mechanism within the housing for powering the rotation of a drill bit for forming a borehole through a formation, the internal motor mechanism including a lobed stator and a helical rotor disposed therein; and at least three spaced apart elongate stabilizing ribs on the housing and extending outwardly therefrom substantially parallel to the longitudinal axis of the housing and continuous along the whole length of the housing between the tapered ends, the stabilizing ribs extending out to contact the formation about the borehole, when the drilling motor is disposed in a borehole, to stabilize the drilling motor within the borehole.

8. The downhole drilling motor of claim 7 wherein there are three stabilizing ribs configured such that the housing has a substantially triangular shape in transverse cross-section.

9. The downhole drilling motor of claim 8 wherein the triangular shape has blunted comers.

10. The downhole drilling motor of claim 7 wherein there are four stabilizing ribs configured such that the housing has a substantially square shape in transverse cross-section.

11. The downhole drilling motor of claim 10 wherein the square shape has blunted comers.

12. The downhole drilling motor of claim 7 wherein the stabilizing ribs are hardened so as to withstand contact with the formation.

13. The downhole drilling motor of claim 7 wherein the stabilizing ribs are formed integral with the housing.

* * * * *